US012042110B2

(12) United States Patent
Bussen

(10) Patent No.: US 12,042,110 B2
(45) Date of Patent: Jul. 23, 2024

(54) LIQUID COLLECTION DEVICES

(71) Applicant: David Frederick Bussen, St. Louis, MO (US)

(72) Inventor: David Frederick Bussen, St. Louis, MO (US)

(73) Assignee: David Frederick Bussen

( * ) Notice: Subject to any disclaimer, the term of this patent is extended or adjusted under 35 U.S.C. 154(b) by 123 days.

(21) Appl. No.: 17/752,427

(22) Filed: May 24, 2022

(65) Prior Publication Data

US 2023/0380652 A1 Nov. 30, 2023

(51) Int. Cl.
*A47L 13/52* (2006.01)

(52) U.S. Cl.
CPC ..... *A47L 13/52* (2013.01)

(58) Field of Classification Search
None
See application file for complete search history.

(56) References Cited

U.S. PATENT DOCUMENTS

| | | | |
|---|---|---|---|
| 652,125 A | 6/1900 | Lillis | |
| 678,906 A | 7/1901 | Rogers | |
| 1,748,336 A | 2/1930 | Finnell | |
| 2,396,645 A | 3/1946 | Dolce | |
| 3,121,248 A | 2/1964 | Ferguson | |
| 4,548,351 A | 10/1985 | Gusic | |
| 5,353,982 A | 10/1994 | Perkins et al. | |
| 5,402,915 A | 4/1995 | Hogan | |
| 5,457,844 A | 10/1995 | Hanna et al. | |
| 6,029,839 A | 2/2000 | Mansouri | |
| 6,477,733 B1 | 11/2002 | Kuhns | |
| 11,213,183 B2 | 1/2022 | Nadeau | |
| 2010/0065448 A1* | 3/2010 | Vargas | A47L 13/52 206/223 |
| 2019/0343364 A1* | 11/2019 | Nadeau | A47L 13/51 |

FOREIGN PATENT DOCUMENTS

| | | | |
|---|---|---|---|
| CN | 201139535 | Y | 10/2008 |
| CN | 204246083 | U | 4/2015 |
| CN | 105310620 | A | 2/2016 |
| CN | 215211934 | U | 12/2021 |
| DE | 1918331 | U | 6/1965 |
| EP | 1736419 | A1 | 12/2006 |
| KR | 20150003042 | U | 8/2015 |
| WO | WO-2001079072 | A1 | 10/2001 |

* cited by examiner

*Primary Examiner* — Natasha N Campbell
*Assistant Examiner* — Pradhuman Parihar
(74) *Attorney, Agent, or Firm* — Harness, Dickey & Pierce, P.L.C.

(57) ABSTRACT

A liquid collection device includes a bottom member, a sidewall extending from the bottom member, and a ramp member extending from the bottom member towards the sidewall at an angle relative to the bottom member. The ramp member and the bottom member at least partially define a cavity therebetween. The liquid collection device further includes an absorbent material disposed at least partially in the cavity and configured to absorb liquid in the cavity. Other example liquid collection devices and methods of collecting liquid from surfaces with collection devices are also disclosed.

15 Claims, 4 Drawing Sheets

LIQUID COLLECTION DEVICES

FIELD

The present disclosure relates to liquid collection devices.

BACKGROUND

This section provides background information related to the present disclosure which is not necessarily prior art.

Dustpans are commonly employed by users to collect debris and/or liquid from surfaces. Users employ brooms or other user-operated devices to force debris and/or liquid into the dustpans, and then remove the debris and/or liquid from the dustpans as desired so that the dustpans may be used again.

SUMMARY

This section provides a general summary of the disclosure, and is not a comprehensive disclosure of its full scope or all of its features.

According to one aspect of the present disclosure, a collection device for collecting liquid from a surface is disclosed. The collection device includes a bottom member defined by at least a first edge and a second edge, a sidewall extending from the bottom member adjacent to the second edge, and a ramp member extending from the bottom member adjacent to the first edge towards the sidewall at an angle relative to the bottom member. The ramp member and the bottom member at least partially define a cavity therebetween. The bottom member extends a length between the first edge and the second edge, and the ramp member extends a distance less than the length of the bottom member. The collection device further includes an absorbent material disposed at least partially in the cavity between the ramp member and the bottom member, the absorbent material configured to absorb liquid in the cavity.

According to another aspect of the present disclosure, a method of collecting liquid from a surface with a collection device is disclosed. The collection device includes a bottom member defined by at least a first edge and a second edge, a sidewall extending from the bottom member adjacent to the second edge, a ramp member extending from the bottom member adjacent to the first edge towards the sidewall at an angle relative to the bottom member, and an absorbent material. The bottom member, the sidewall, and the ramp member are cardboard. The method includes forcing liquid to flow up the ramp member and to a first cavity defined by the bottom member, the sidewall, and the ramp member. At least a portion of the liquid flows from the first cavity to a second cavity and into contact with the absorbent material disposed in the second cavity. The second cavity is defined by the bottom member and the ramp member. The method further includes disposing of the collection device after a single use.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts and/or features throughout the several views of the drawings.

DETAILED DESCRIPTION

Example embodiments will now be described more fully with reference to the accompanying drawings.

Collection devices are commonly employed by users to collect debris and/or liquid from surfaces. For example, a user may employ a broom, a squeegee, or another suitable user-operated device to force debris and/or liquid into a collection device (e.g., a dustpan), and then remove the debris and/or liquid from the collection device as desired so that the collection device may be used again. In such examples, the debris and/or liquid may move freely (e.g., unrestrained, uncontrolled, etc.) within a portion of the collection device. In some cases, the unrestrained debris and/or liquid may spill out of the collection device before the debris and/or liquid is properly discarded due to actions of the user (e.g., inadvertently tilting, bumping, etc. the collection device).

Uniquely, the collection devices disclosed herein enable users to collect liquids such as water, oil, etc. from surfaces and restrain at least a portion (and sometimes all) of the liquids with absorbing materials in the collection devices. For example, and as further explained herein, one or more types of liquid may be collected and selectively absorbed with one or more absorbing materials in a collection device. This effectively restrains the liquid within the collection device and substantially prevents the liquid from spilling out of the collection device. Subsequently, the entire collection device including absorbed liquid(s) may be discarded and/or portions (e.g., the absorbing material(s), etc.) of the collection device may be discarded as desired. As such, the collection devices herein may be one-time use devices that enable users to easily collect, restrain, and dispose of liquids as desired.

Figure 1:
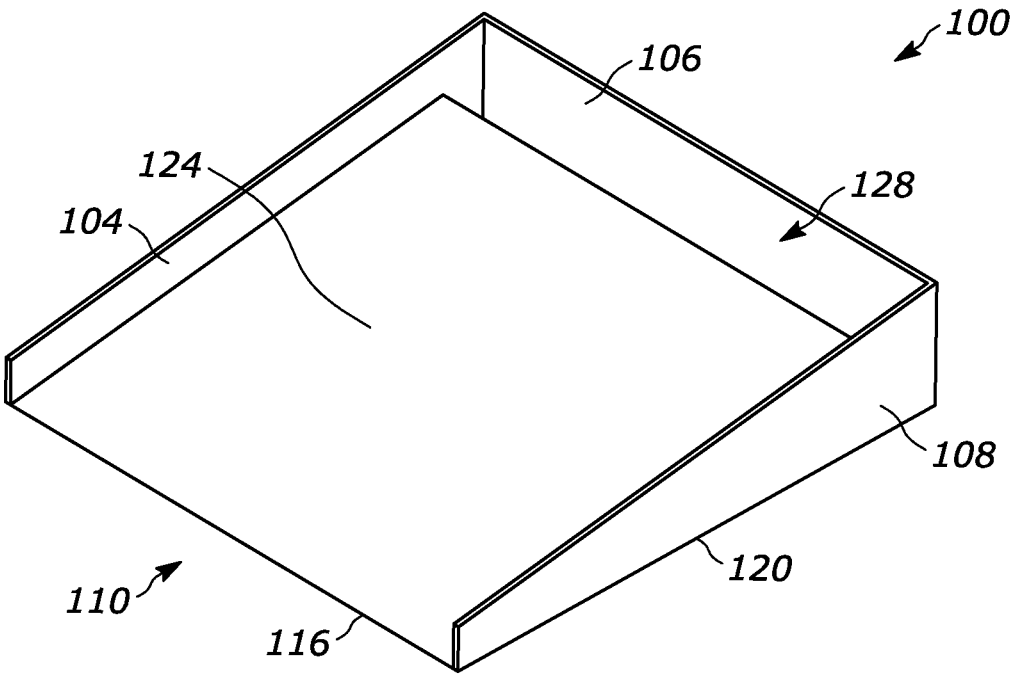
FIG. 1 is a front isometric view of a liquid collection device, according to one example embodiment of the present disclosure.
Figure 2:
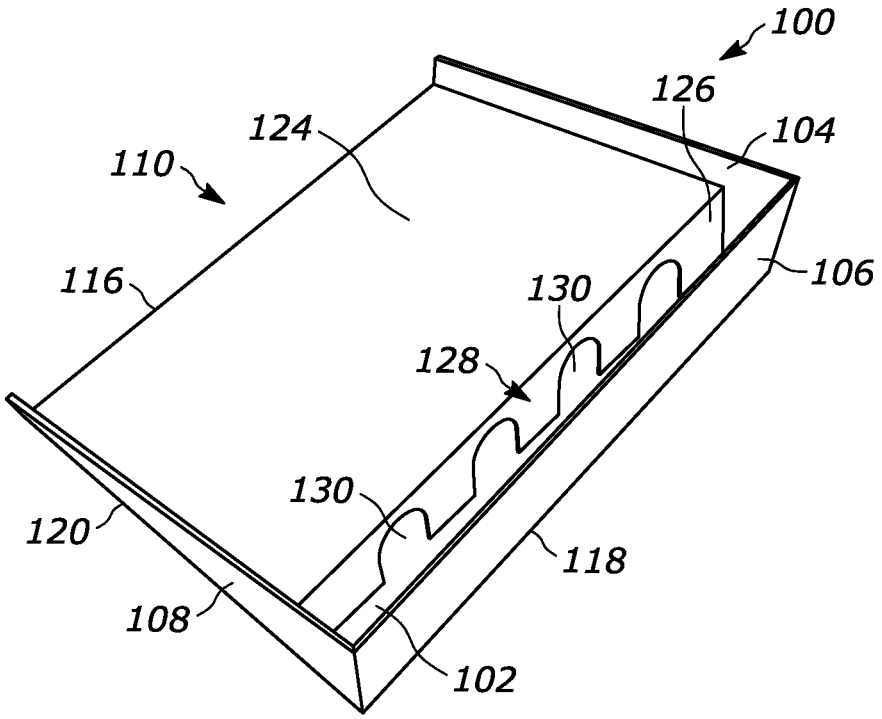
FIG. 2 is a rear perspective view of the liquid collection device of FIG. 1.
Figure 3:
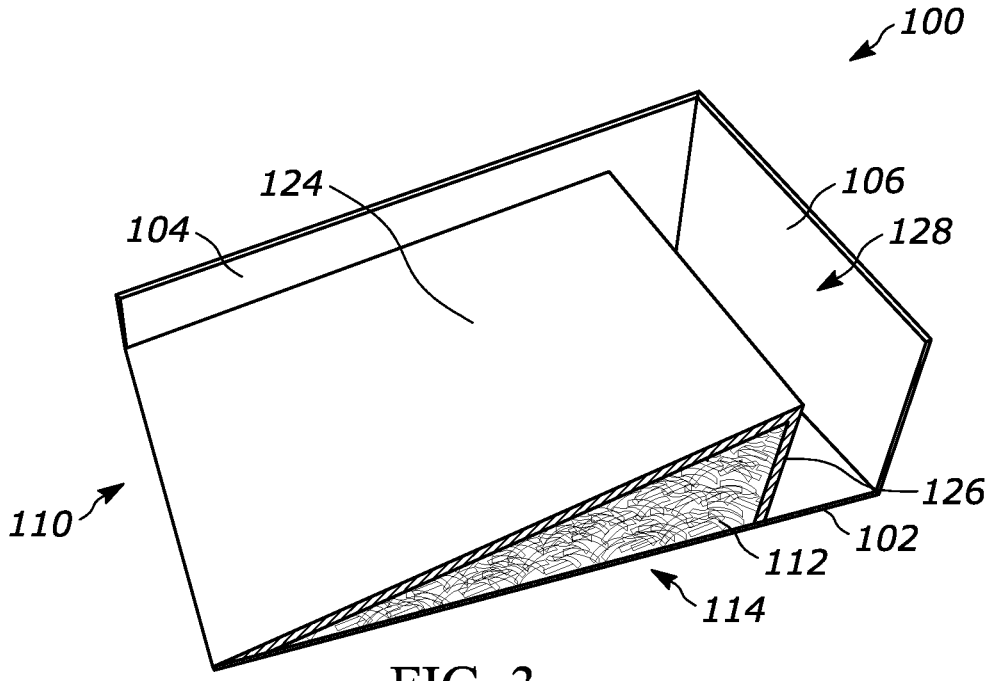
FIG. 3 is a cut side perspective view of the liquid collection device of FIG. 1, where the liquid collection device includes a shredded absorbent material.

For example, a collection device for collecting liquid from a surface according to one example embodiment of the present disclosure is illustrated in FIGS. 1-3, and indicated generally by reference number 100. As shown in FIGS. 1-3, the liquid collection device 100 includes a bottom member 102, multiple sidewalls 104, 106, 108 extending from the bottom member 102, a ramp member 110 extending from the bottom member 102, and an absorbent material 112 disposed in a cavity 114 between (and at least partially defined by) the ramp member 110 and the bottom member 102. The absorbent material 112 absorbs liquid (or a portion thereof) that collects in the cavity 114. For example, and as further explained below, one or more types of liquid may be urged from a surface (e.g., a floor, etc.) onto the ramp member 110 and then flow up and pass over the ramp member 110 (e.g., by actions of a user, etc.). The liquid eventually collects in the cavity 114 where the absorbent material 112 absorbs at least a portion of the collected liquid.

As shown in FIGS. 1-3, the bottom member 102 includes multiple edges defining a perimeter. Specifically, the bottom member 102 includes four edges defining a square or rectangular-shaped perimeter. Of which, three of the edges 116, 118, 120 are shown in FIGS. 1-3. For example, the perimeter of the bottom member 102 may have a length between the opposing edges 116, 118 and the same or a different length between the other edge (not shown) and the edge 120. In other examples, the bottom member 102 may include more or less edges (e.g., three edges, five edges, six edge, etc.) and/or define another suitable shaped perimeter (e.g., a square-shaped perimeter, a triangle-shaped perimeter, a pentagon-shaped perimeter, etc.).

In the example of FIGS. 1-3, the ramp member 110 and the sidewalls 104, 106, 108 extend from different portions of the bottom member 102. Specifically, and as shown, the sidewalls 106, 108 extend from the bottom member 102 adjacent to the edges 118, 120, respectively, the sidewall 104 extends from the bottom member 102 adjacent to the other edge (not shown), and the ramp member 110 extends from the bottom member 102 adjacent to the edge 116. In such examples, the sidewalls 104, 106, 108 and the ramp member 110 may extend from the edges as shown in FIGS. 1-3, or from portions of the bottom member 102 near the edges.

Additionally, each of the ramp member 110 and the sidewalls 104, 106, 108 may extend an entire length of its corresponding edge of the bottom member 102. For example, the sidewall 106 may extend the entire length of the edge 118 of the bottom member 102. The other sidewall 108 and the ramp member 110 may be similarly configured with respect to the edges 120, 116.

In some embodiments, the sidewalls 104, 106, 108 may extend from the bottom member 102 at about a ninety-degree angle relative to the bottom member 102, as shown in FIGS. 1-3. In such examples, the sidewalls 104, 106, 108 and the bottom member 102 are substantially perpendicular to each other. In other embodiments, the sidewalls 104, 106, 108 may extend at different angles (e.g., obtuse angles and/or acute angles) relative to the bottom member 102.

Additionally, and as shown in FIGS. 1-3, the ramp member 110 extends from the bottom member 102 adjacent to the edge 116 towards the sidewall 106 at a defined angle relative to the bottom member 102. This creates an incline between the edge 116 of the bottom member 102 and the sidewall 106. The defined angle between the ramp member 110 and the bottom member 102 may be any suitable acuate angle such as, for example, ten degrees, twenty degrees, thirty degrees, etc. to ensure liquid can be easily forced up the incline.

As shown in FIGS. 1-3, the ramp member 110 includes an inclined member 124 extending from the bottom member 102 adjacent to the edge 116 and a wall 126 extending between the inclined member 124 and the bottom member 102. In such examples, the inclined member 124 extends at the defined angle relative to the bottom member 102, and the wall 126 extends at about a ninety-degree angle relative to the bottom member 102. In other embodiments, the wall 126 may extend at another suitable angle relative to the bottom member 102 such as sixty degrees, seventy-five degrees, one hundred degrees, etc.

Additionally, the ramp member 110 may extend a defined distance from the edge 116 of the bottom member 102. In some examples, the distance may be less than the length of the bottom member 102 between the edges 116, 118. This distance may be a length between opposing edges of the inclined member 124 (e.g., the length between an edge of the inclined member 124 adjacent to the edge 116 and an opposing edge of the inclined member 124 adjacent to the optional wall 126).

The cavity 114 is defined by the ramp member 110 and the bottom member 102. More specifically, in the example of FIGS. 1-3, the cavity 114 is defined by the inclined member 124 and the wall 126 of the ramp member 110 and a portion of the bottom member 102. In such examples, a cross section of the cavity 114 is triangular. In other embodiments, the wall 126 of FIGS. 1-3 may be omitted. For example, the ramp member 110 may only include the inclined member 124 coupled to, for example, the sidewalls 104, 108. In such examples where the wall 126 is omitted, the cavity 114 may be defined by the inclined member 124, the bottom member 102, and (in some examples) the sidewall 106.

In some embodiments, the liquid collection device 100 may include another cavity adjacent to the cavity 114. For example, and as shown in FIGS. 1-3, the liquid collection device 100 includes a cavity 128 defined by a portion of the bottom member 102, the sidewall 106, and the wall 126 of the ramp member 110. In such examples, the cavities 114, 128 are separated by the wall 126.

In the example of FIGS. 1-3, the cavities 114, 128 may be in fluid communication with each other. For example, and as shown in FIG. 2, the wall 126 of the ramp member 110 includes openings 130 providing a fluid pathway between the cavities 114, 128. As shown, the openings 130 extend from the bottom member 102. In such examples, the openings 130 allow liquid, after passing over the ramp member 110, to flow from the cavity 128 to the cavity 114 and into contact with the absorbent material 112. As such, liquid that collects in the cavity 128 may flow through the openings 130 along the bottom member 102 and into the cavity 114.

As shown in FIG. 2, the wall 126 defines four openings 130 each having a dome shape. For example, each opening 130 is defined by two side portions extending parallel to each other, and an arc portion extending between the side portions. In other examples, the wall 126 may define more or less than four openings 130 having the same dome shape or a different shape. For example, the wall 126 may define one opening having a rectangular shape, three openings having the dome shape, five openings having a triangle shape, six openings with some having the dome shape and others having a rectangular shape, etc.

The absorbent material 112 in the cavity 114 may be positioned in the cavity 114 in any suitable manner. For example, the absorbent material 112 may be free flowing (e.g., loose, etc.) and may substantially fill the entire cavity 114. In such examples, the absorbent material 112 may be positioned throughout the cavity 114 and adjacent to a top surface of the bottom member 102 and a bottom surface of the inclined member 124, as shown in FIG. 3. In other examples, the absorbent material 112 may partially fill the cavity 114. The amount of fill of the absorbent material 112 in the cavity 114 may depend on, for example, a weight to absorbing ratio. For example, it may be desirable to use a minimal amount of a particular type of absorbent material (e.g., to reduce weight) that can absorb a large amount of liquid. For instance, one ounce of some absorbent materials may absorb twelve ounces or more of liquid.

Additionally, the absorbent material 112 and other absorbent materials disclosed herein may include any suitable material or materials for absorbing liquid. In some examples, the absorbent material 112 may be selected to absorb one or more particular types of liquid (e.g., water, oil, etc.). In such examples, the absorbent material 112 may substantially absorb one type of liquid (e.g., oil, etc.) and not other types of liquid (e.g., water, etc.).

In the example of FIGS. 1-3, the absorbent material 112 includes a shredded material. For instance, the shredded material may include one or more of a wood fiber material, a paper fiber material, etc. In some examples, the shredded material may include material commonly used in diapers for absorbing liquid.

Figure 4:
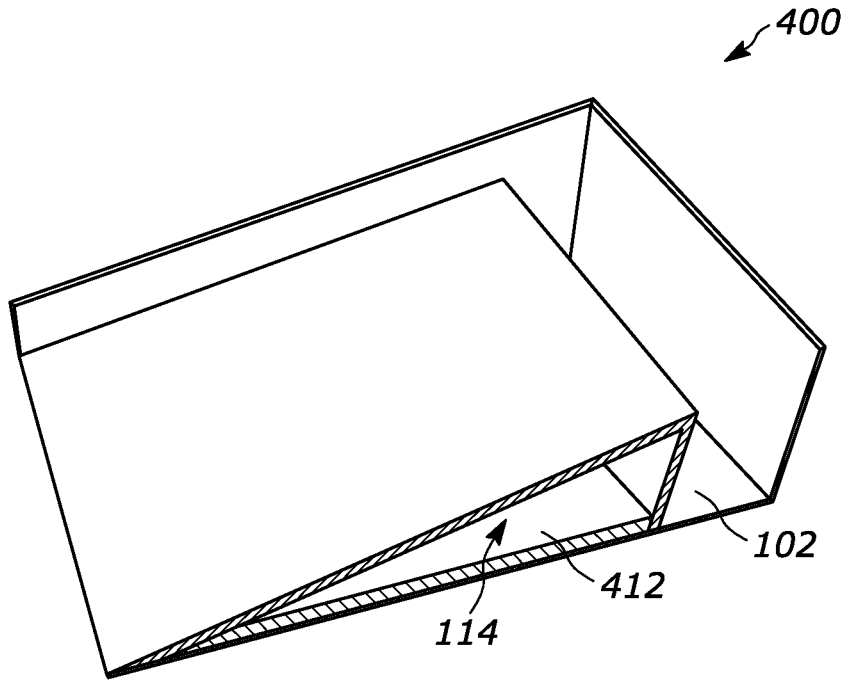
FIG. 4 is a cut side perspective view of a liquid collection device including an absorbent pad, according to another example embodiment.

In other examples, the absorbent material disclosed herein may include an absorbent pad attached to, for example, the bottom member. For example, FIG. 4 illustrates a liquid collection device 400 similar to the liquid collection device 100 of FIGS. 1-3, but including an absorbent pad 412. More specifically, the liquid collection device 400 includes the bottom member 102 and the cavity 114 of FIGS. 1-3, and the absorbent pad 412 disposed in the cavity 114 and attached (e.g., adhered, mechanically attached via fasteners, etc.) to the bottom member 102.

Figure 5:
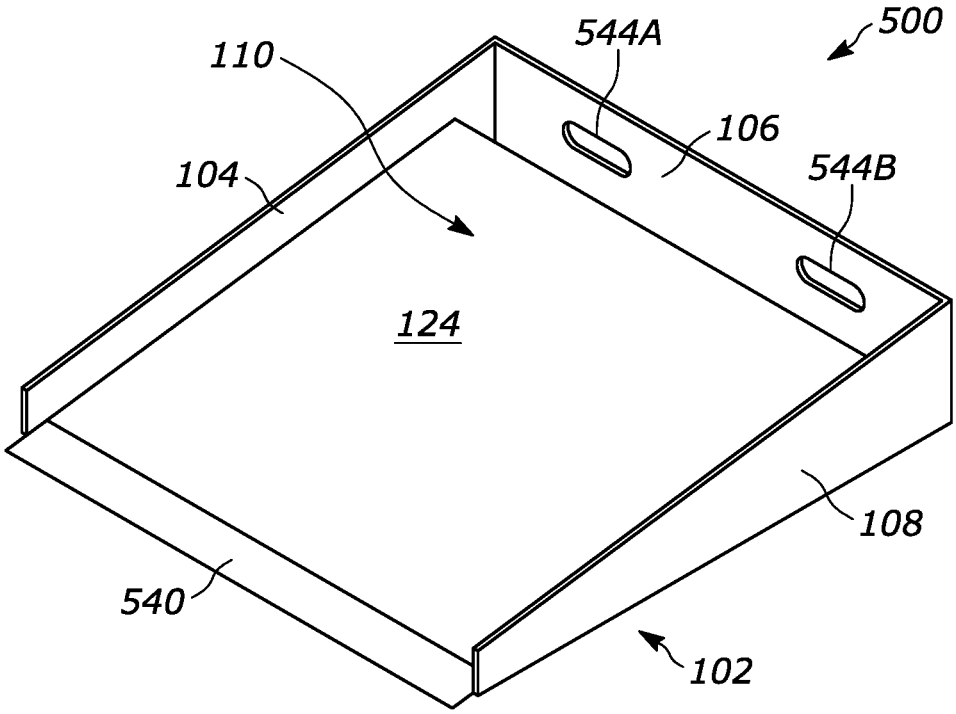
FIG. 5 is a front isometric view of a liquid collection device including an interface, according to another example embodiment.

In some embodiments, any one of the liquid collection devices disclosed herein may include an interface to form a transition region between a ramp member and a surface where liquid may be present. For example, FIG. 5 illustrates a liquid collection device 500 similar to the liquid collection device 100 of FIGS. 1-3, but including an interface 540. More specifically, the liquid collection device 500 includes the bottom member 102, the ramp member 110 and the sidewalls 104, 106, 108 of FIGS. 1-3, and the interface 540 attached (e.g., adhered, mechanically attached via fasteners, etc.) to a portion of the ramp member 110. In such examples, the interface 540 forms a transition region between the ramp member 110 (e.g., the inclined member 124) and a surface (e.g., a floor, etc.), thereby permitting a user to easily urge liquid on the surface onto the ramp member 110.

As shown in FIG. 5, the interface 540 extends along an edge of the ramp member 110 where the inclined member 124 and the bottom member 102 converge. More specifically, in the example of FIG. 5, the interface 540 extends along the entire edge of the ramp member 110. In such examples, the interface 540 may flare outward near the sidewalls 104, 108, extend substantially parallel with the sidewalls 104, 108, or flare inward near the sidewalls 104, 108. In other embodiments, the interface 540 may extend along a portion of the edge of the ramp member 110 where the inclined member 124 and the bottom member 102 converge. For example, the interface 540 may extend along only a middle portion of the edge of the ramp member 110, etc.

In the example of FIG. 5, the interface 540 may include any suitable material. For example, the interface 540 may include a rubber material, a plastic material, etc. In some examples, the interface 540 may be flexible due to, for example, the selected material. In such examples, the interface 540 may be flush with the surface where liquid may be present. For example, the interface 540 may naturally rest against and be flush with the surface, a force may be applied to the liquid collection device 500 to cause the interface 540 to be flush with the surface, etc.

Additionally, in some embodiments, any one of the liquid collection devices disclosed herein may include openings (e.g., hand holes) for receiving a user's hands. For example, and as shown in FIG. 5, the liquid collection device 500 includes openings 544A, 544B. In such examples, the user may grasp the liquid collection device 500 via the openings 544A, 544B and manipulate the device 500 as desired. For example, the user may pick up the entire device 500 with the openings 544A, 544B and move the device 500 to a proper disposal container as explained herein, the user may pick up (e.g., tilt) the side of the device 500 adjacent to the sidewall 106 to encourage liquid to flow in a direction of where absorbent material is located, etc.

In the particular example of FIG. 5, the openings 544A, 544B are positioned in the sidewall 106. More specifically, the sidewall 106 define the openings 544A, 544B. In such examples, the openings 544A, 544B may be positioned in the sidewall 106 at about equal distances from the sidewalls 104, 108, and at about equal distances between the bottom member 102 and the top of the sidewall 106 (e.g., at about a midpoint between the bottom member 102 and the top of the sidewall 106). In other examples, the openings 544A, 544B may be positioned in another suitable location in the sidewall 106.

Additionally, in some examples, one or both openings 544A, 544B may be positioned in (e.g., defined by) another one of the sidewalls. For example, the opening 544A may be positioned in the sidewall 104 and the opening 544B may be positioned in the sidewall 108. In other examples, both openings 544A, 544B may be positioned in the sidewall 104 or the sidewall 108. In still other examples, one of the openings 544A, 544B may be positioned in the sidewall 106 and the other opening 544A, 544B may be positioned in the sidewall 104 or the sidewall 108.

Figure 6:
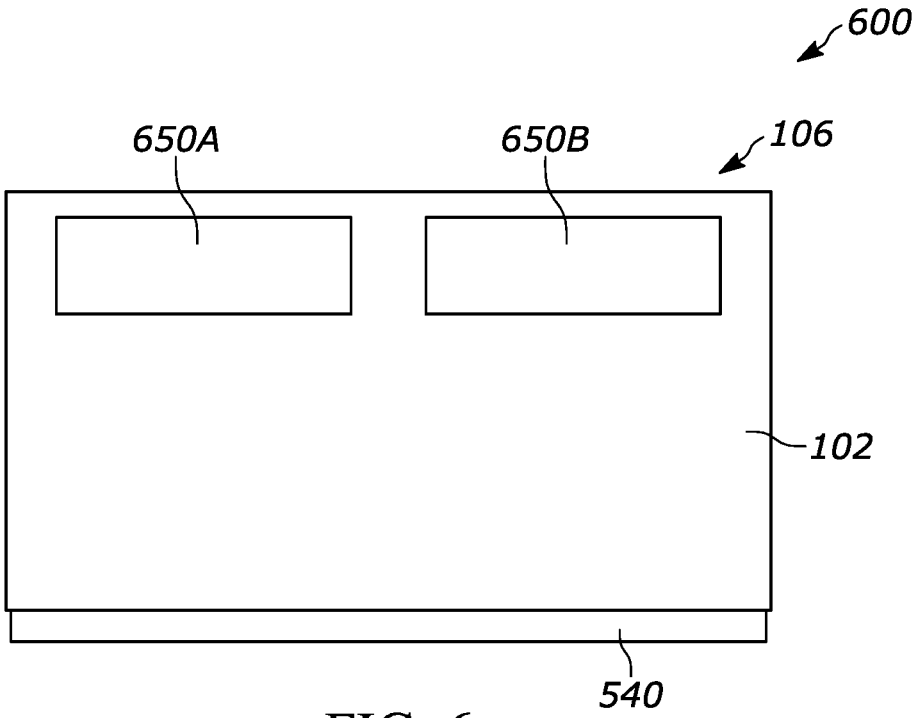
FIG. 6 is a bottom view of a liquid collection device including two skid pads, according to another example embodiment.

In some embodiments, any one of the liquid collection devices disclosed herein may include one or more skid pads to inhibit movement of the liquid collection device. For example, FIG. 6 illustrates a liquid collection device 600 similar to the liquid collection devices 100, 500 of FIGS. 1-3 and 5, but including two skid pads 650A, 650B. More specifically, the liquid collection device 600 includes the bottom member 102 of FIGS. 1-3, the interface 540 of FIG. 5, and the skid pads 650A, 650B attached (e.g., adhered, mechanically attached via fasteners, etc.) to a bottom surface of the bottom member 102 to inhibit movement of the liquid collection device 600 along a surface when the skid pads 650A, 650B contact the surface.

In the example of FIG. 6, the skid pads 650A, 650B are attached to the bottom member 102 adjacent to an edge near the sidewall 106. In such examples, the skid pads 650A, 650B may create a slope along the bottom member 102 between the cavities 114, 128 (not shown) in the liquid collection device 600 when the liquid collection device 600 is placed on the surface where liquid may be present. For instance, when the skid pads 650A, 650B are employed, one end of the liquid collection device 600 near the sidewall 106 may be further from the surface than the opposing end of the liquid collection device 600 near the interface 540. As such, liquid in the cavity 128 may flow (e.g., without user interaction) into the cavity 114 where an absorbent material is disposed.

Although the example of FIG. 6 shows two rectangular-shaped skid pads 650A, 650B positioned near the sidewall 106, it should be appreciated that more or less skid pads having different shapes may be employed and positioned at different locations along the bottom member 102. For example, the liquid collection device 600 may include one circular-shaped skid pad attached to the bottom member 102 near the sidewall 106 or attached to a middle portion of the bottom member 102. In other embodiments, the liquid collection device 600 may include three or four skid pads having a square shape, a triangle shape, etc. Additionally, in some embodiments, it may be desirable to have one skid pad extending across the bottom member 102, evenly spaced skid pads, etc. to ensure the liquid collection device 600 is evenly balanced when contacting the surface.

Additionally, the skid pads 650A, 650B may include any suitable material. For example, the pads 650A, 650B may include a rubber material, a plastic material, etc. In some examples, the pads 650A, 650B may be flexible due to, for example, the selected material.

Figure 7:
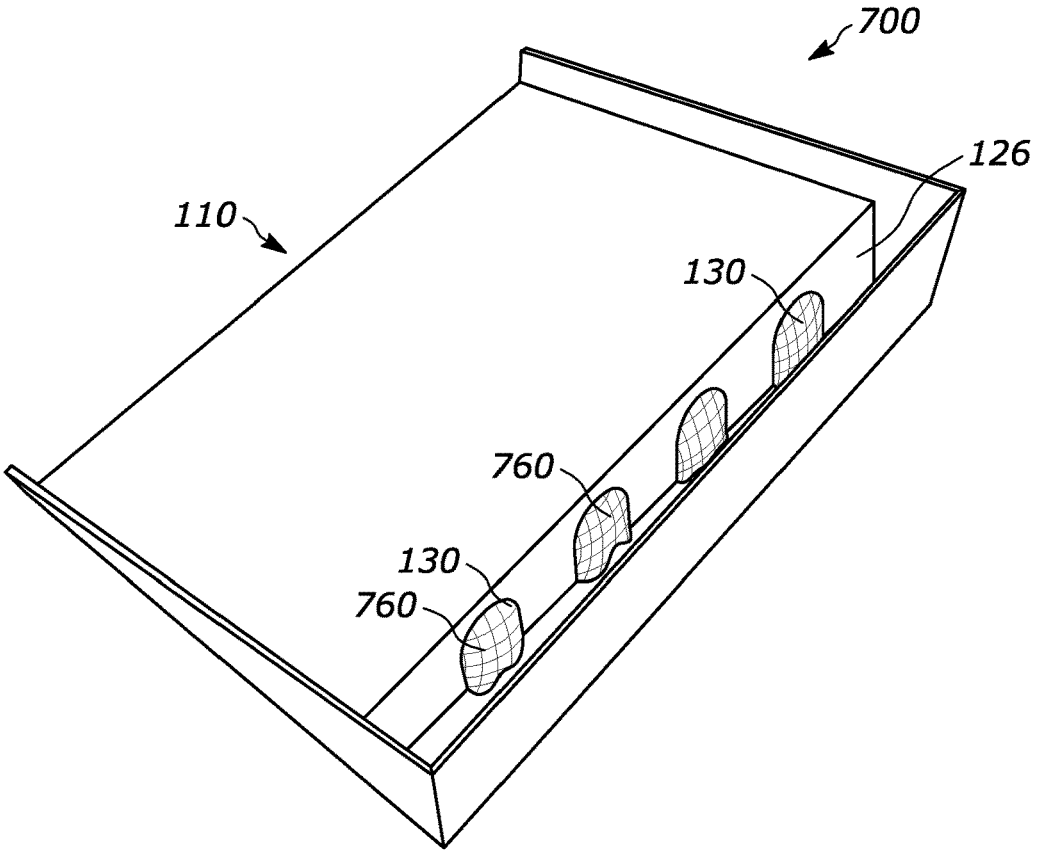
FIG. 7 is a rear perspective view of a liquid collection device according to another example embodiment.

FIG. 7 illustrates a liquid collection device 700 similar to the liquid collection device 100 of FIGS. 1-3, but including porous barriers for covering openings in the device 700. For example, the liquid collection device 700 of FIG. 7 includes the ramp member 110 having the wall 126 with the openings 130 of FIGS. 1-3 and porous barriers 760 covering the openings 130. In such examples, the porous barriers 760 may be attached (e.g., adhered, etc.) to the wall 126 of the ramp member 110. The porous barriers 760 may substantially prevent absorbent material (e.g., the absorbent material 112 of FIGS. 1-3, etc.) in a cavity (e.g., the cavity 114 of FIGS. 1-3) from escaping while allowing liquid to flow into the cavity from another cavity (e.g., the cavity 128 of FIGS. 1-3, etc.).

In the example of FIG. 7, the porous barriers 760 each may include a mesh material that covers a portion of the corresponding opening 130 or the entire corresponding opening 130. The mesh material may include any suitable type of material such as plastic.

Figure 8:
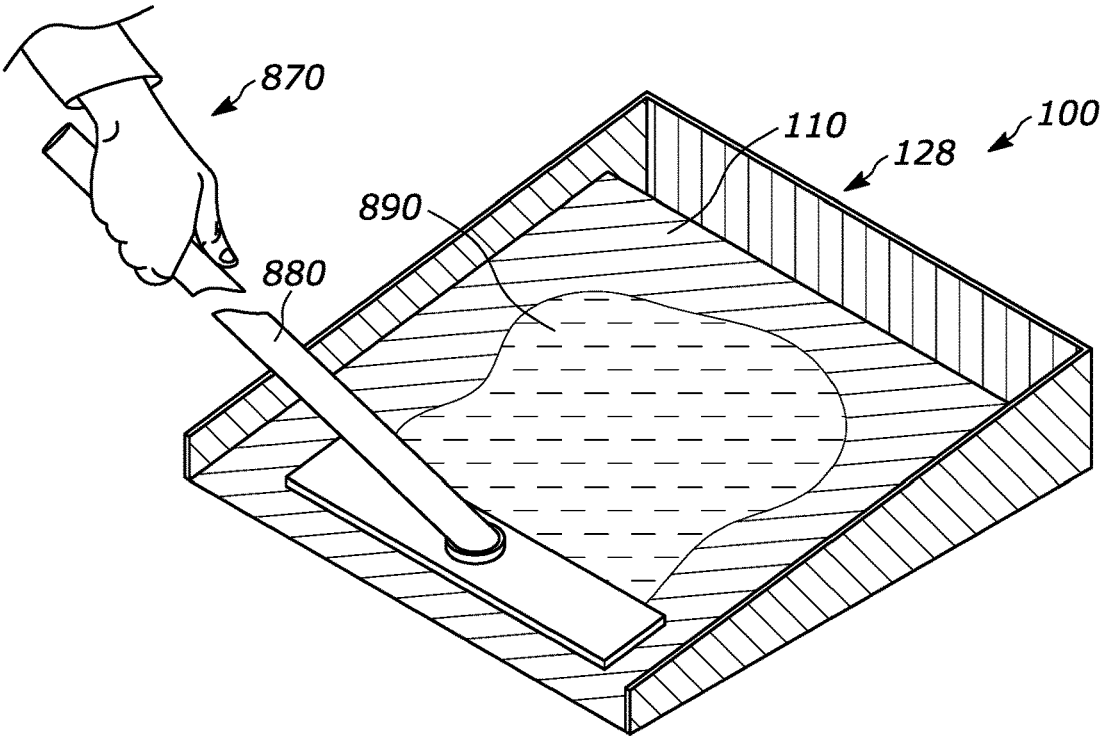
FIG. 8 is a front isometric view of the liquid collection device of FIG. 1 and a user, according to another example embodiment.

It should be appreciated that any one of the liquid collection devices disclosed herein may be used to collect liquid from a surface (e.g., a floor, etc.). For example, FIG. 8 illustrates the liquid collection device 100 of FIGS. 1-3 and a user 870 forcing liquid 890 to flow up the ramp member 110 and to the cavity 128. After the liquid 890 falls into the cavity 128, at least a portion of the liquid 890 flows from the cavity 128 to the cavity 114 (not shown in FIG. 8) and into contact with the absorbent material 112 (not shown in FIG. 8) disposed in the cavity 114. The time taken for the liquid 890 to flow into the cavity 114 may vary depending on, for example, the viscosity of the liquid, the angle of the bottom member, etc. Once in the cavity 114, the absorbent material 112 may absorb at least some of the liquid depending on the type of liquid present, the type of absorbent material used, etc. as explained herein. The time taken for the absorbent material to absorb the liquid may vary depending on, for example, the viscosity of the liquid, the wicking ability of the absorbent material, etc.

After the liquid 890 or a portion thereof is absorbed by the absorbent material 112, the user 870 may dispose of the liquid collection device 100 after a single use. For example, the user 870 may dispose of the liquid collection device 100 after collecting liquid in one location (e.g., in an aisle of a grocery store, on a floor in a warehouse, etc.). In some examples, the user 870 may dispose of the liquid collection device 100 by throwing the liquid collection device 100 with the absorbed liquid in a trash container, a recycling container, etc. depending on, for example, the type of liquid collected. For example, the user 870 may dispose of the liquid collection device 100 according to approved governmental (e.g., federal, state, local, etc.) procedures and/or approved governmental disposal facilities. In such examples, the used liquid collection device 100 with the absorbed liquid is not restocked, returned to its previous storage location, etc.

In some examples, the user 870 may urge a portion of the liquid 890 to flow from the cavity 128 to the cavity 114 (e.g., via openings in the ramp member 110). For example, the user 870 may tilt the liquid collection device 100 to encourage the liquid 890 to flow in a direction towards the cavity 114. In other examples, the liquid collection device 100 may include one or more skid pads as disclosed herein to create an angled bottom member relative to the surface. This may allow the liquid 890 to flow (via gravity) in a direction towards the cavity 114. In such examples, the user 870 may wait a period of time (e.g., 5 seconds, 10 seconds, 20 seconds, 1 minute, 5 minutes, 20 minutes, etc.) to allow the liquid 890 to flow from the cavity 128 to the cavity 114 before disposing of the liquid collection device 100.

The user 870 may force the liquid 890 or a portion thereof to flow up the ramp member 110 and to the cavity 128 with a device such as a user-operated device. For instance, in the example of FIG. 8, the user 870 employs a squeegee 880 to force the liquid 890 to flow up the ramp member 110 and to the cavity 128. In other examples, another suitable device may be employed such as a broom, a brush, etc. In some examples, the squeegee 880 may include rubber, a looped foam, and/or another suitable material for moving liquid.

In some embodiments, the liquid 890 may flow in different directions on the liquid collection device 100. For example, the liquid 890 may move in one direction when the user 870 forces the liquid 890 or a portion thereof up the ramp member 110. The liquid 890 may move in an opposite direction when it flows from the cavity 128 to the cavity 114 under the ramp member 110.

Although FIG. 8 shows a particular arrangement of the liquid collection device 100, it should be appreciated that the liquid collection device 100 may include one or more additional features disclosed herein such as, for example, one or more skid pads, interfaces, porous barriers, etc.

The liquid collection devices disclosed herein may be formed of one or more materials. For example, any one of the liquid collection devices may be formed at least partially of cardboard (e.g., corrugated cardboard, etc.). For instance, the bottom member, the sidewalls, and the ramp member of the liquid collection device 100 of FIG. 8 are shown as being cardboard. In other examples, the liquid collection devices may include another suitable material such as plastic (e.g., corrugated plastic, etc.), a combination of materials (e.g., plastic, cardboard, rubber, etc.), etc. In some examples, the liquid collection devices or portions thereof may be waterproof. For instance, cardboard used in the liquid collection devices may be coated with a polyurethane, an acrylic paint, a lacquer spray, etc. to waterproof the cardboard.

Additionally, in some examples, portions of the liquid collection devices may be formed from a single piece of cardboard. For example, a single piece of cardboard may be cut, punched/pressed out, etc. and folded at defined locations (e.g., indicated by perforations, etc.) to form the bottom member, the sidewalls, and the ramp member of one of the liquid collection devices disclosed herein. In such examples, an adhesive (e.g., glue, etc.) may be used at a single seam between, for example, one sidewall and the ramp member to secure the liquid collection device. In other examples, the bottom member, the sidewalls, and the ramp member of the liquid collection device may be formed from multiple pieces of cardboard (or another material) and adhered together.

Further, the liquid collection devices disclosed herein may be any suitable size. For example, and with reference to the liquid collection device 100 of FIGS. 1-3, the sidewall 106 may be 42 inches long by 7 inches tall, and the wall 126 may be 6.5 inches tall. The openings 130 may be 3 inches wide (e.g., between the parallel side portions), and 3.5 inches tall (e.g., to a top of the dome shape). In some examples, adjacent openings 130 may be 3 inches apart. Additionally, the cavity 114 may have a right triangle cross-sectional shape with a hypotenuse of 20 inches and a leg of 4 inches. The cavity 128 may be 3 inches wide (e.g., between the sidewall 106 and the wall 126). Although specific dimensions are provided with respect to the liquid collection device 100, it should be appreciated that the device 100 may include other suitable dimensions and/or any one of the other liquid collection devices disclosed herein may include the same or different dimensions. For example, in some embodiments, the sidewall 106 may be 30 inches long, 32 inches long, etc. The liquid collection devices disclosed herein may vary in size without change in functionality of the features disclosed herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A collection device for collecting liquid from a surface, the collection device comprising:

a bottom member defined by at least a first edge and a second edge, the bottom member having a length between the first edge and the second edge;

a sidewall extending from the bottom member adjacent to the second edge;

a ramp member extending from the bottom member adjacent to the first edge towards the sidewall at an angle relative to the bottom member, the ramp member and the bottom member at least partially defining a first cavity therebetween, the ramp member extending a distance less than the length of the bottom member, the ramp member including an inclined member extending from the bottom member adjacent the first edge and a wall extending between the inclined member and the bottom member, wherein the bottom member, the sidewall, and the wall of the ramp member define a second cavity in fluid communication with the first cavity;

an absorbent material disposed at least partially in the first cavity between the ramp member and the bottom member, the absorbent material configured to absorb liquid in the first cavity, wherein the wall of the ramp member defines one or more openings configured to allow the liquid, after passing over the ramp member, to flow from the second cavity to the first cavity and into contact with the absorbent material; and one or more porous barriers covering at least a portion of the one or more openings in the wall of the ramp member, the one or more porous barriers configured to prevent the absorbent material in the first cavity from escaping and to allow the liquid to flow from the second cavity to the first cavity.

2. The collection device of claim 1, wherein the ramp member includes a first edge adjacent to the first edge of the bottom member and a second edge adjacent to the sidewall, and wherein the collection device further comprises an interface attached to the ramp member and extending along at least a portion of the first edge of the ramp member.

3. The collection device of claim 2, wherein the interface is flexible.

4. The collection device of claim 1, wherein the bottom member includes a top surface adjacent to the ramp member and a bottom surface opposing the top surface, and wherein the collection device further comprises at least one skid pad attached to the bottom surface of the bottom member to inhibit movement of the collection device along the surface when the at least one skid pad contacts the surface.

5. The collection device of claim 4, wherein the at least one skid pad is flexible.

6. The collection device of claim 4, wherein the at least one skid pad is attached to the bottom member adjacent to the second edge.

7. The collection device of claim 1, wherein the absorbent material includes at least one absorbent pad attached to the bottom member.

8. The collection device of claim 1, wherein the absorbent material includes a shredded material.

9. The collection device of claim 1, wherein the bottom member, the sidewall, and the ramp member are cardboard.

10. A method of collecting liquid from a surface with a collection device, the collection device including a bottom member defined by at least a first edge and a second edge, a sidewall extending from the bottom member adjacent to the second edge, a ramp member extending from the bottom member adjacent to the first edge towards the sidewall at an angle relative to the bottom member, and an absorbent material, wherein the bottom member has a length between the first edge and the second edge, wherein the ramp member extends a distance less than the length of the bottom member, wherein the bottom member, the sidewall, and the ramp member are cardboard, wherein the ramp member includes an inclined member extending from the bottom member adjacent to the first edge and a wall extending between the inclined member and the bottom member, wherein the wall defines one or more openings, and wherein one or more porous barriers cover at least a portion of the one or more openings in the wall of the ramp member, the method comprising:

forcing liquid to flow up the ramp member and to a first cavity defined by the bottom member, the sidewall, and the ramp member, wherein at least a portion of the liquid flows from the first cavity to a second cavity via the one or more openings and into contact with the absorbent material disposed in the second cavity, wherein the second cavity is defined by the bottom member and the ramp member, and where the one or more porous barriers are configured to prevent the absorbent material from escaping and to allow the liquid to flow from the first cavity to the second cavity; and disposing of the collection device, wherein the collection device is disposed after a single use.

11. The method of claim 10, wherein forcing the liquid to flow up the ramp member includes forcing the liquid to flow in a first direction, and wherein the portion of the liquid flows in a second direction opposite the first direction from the first cavity to the second cavity.

12. The method of claim 10, wherein forcing the liquid to flow up the ramp member includes forcing, with a user-operated device, the liquid to flow up the ramp member.

13. The method of claim 12, wherein the user-operated device is a squeegee.

14. The method of claim 10, wherein the bottom member includes a top surface and a bottom surface opposing the top surface, wherein the sidewall extends from the top surface, wherein the collection device further comprises at least one skid pad attached to the bottom surface of the bottom member adjacent to the second edge to inhibit movement of the collection device along the surface when the at least one skid pad contacts the surface.

15. The method of claim 10, wherein the ramp member includes a first edge adjacent to the first edge of the bottom member and a second edge adjacent to the sidewall, and wherein the collection device further comprises an interface attached to the ramp member and extending along at least a portion of the first edge of the ramp member to form an interface between the ramp member and the surface.

* * * * *